US008508332B2

(12) United States Patent
Jones et al.

(10) Patent No.: US 8,508,332 B2
(45) Date of Patent: Aug. 13, 2013

(54) ACCESS CONTROL

(75) Inventors: Derek W. Jones, Kirkcudbright (GB); Anthony C. Day, Manchester (GB); Derek Sawyer, Granada (ES); Julian Poyner, Hazel Grove (GB)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 406 days.

(21) Appl. No.: 12/626,258

(22) Filed: Nov. 25, 2009

(65) Prior Publication Data

US 2010/0127821 A1 May 27, 2010

(30) Foreign Application Priority Data

Nov. 25, 2008 (GB) ..... 0821482.7

(51) Int. Cl.
*B60R 25/04* (2006.01)
*H01H 47/02* (2006.01)
*H02H 1/00* (2006.01)

(52) U.S. Cl.
USPC ..... 340/5.2; 340/4.36; 340/5.7; 307/326; 361/1

(58) Field of Classification Search
USPC ..... 340/5.2, 5.21–5.22, 4.36, 5.7; 700/79; 307/326; 361/1
See application file for complete search history.

(56) References Cited

U.S. PATENT DOCUMENTS

| | | | | |
|---|---|---|---|---|
| 4,101,235 | A * | 7/1978 | Nelson | 404/6 |
| 5,198,800 | A * | 3/1993 | Tozawa et al. | 340/573.1 |
| 5,288,164 | A * | 2/1994 | Nasatka | 404/10 |
| 5,971,590 | A * | 10/1999 | Nieminen et al. | 700/213 |
| 6,570,487 | B1 * | 5/2003 | Steeves | 340/5.2 |
| RE39,736 | E * | 7/2007 | Morrill, Jr. | 705/44 |
| 8,078,308 | B2 * | 12/2011 | Lerisson et al. | 700/177 |
| 2002/0082803 | A1 * | 6/2002 | Schiffbauer | 702/159 |
| 2002/0186299 | A1 * | 12/2002 | Cofer | 348/152 |
| 2004/0089793 | A1 * | 5/2004 | Watanabe et al. | 250/221 |
| 2004/0148039 | A1 * | 7/2004 | Farchmin et al. | 700/79 |
| 2006/0015398 | A1 * | 1/2006 | Weik | 705/13 |
| 2007/0205861 | A1 * | 9/2007 | Nair et al. | 340/5.61 |
| 2008/0130956 | A1 * | 6/2008 | Jordan et al. | 382/115 |

FOREIGN PATENT DOCUMENTS

| | | | |
|---|---|---|---|
| JP | 2008-7992 | A | 1/2008 |
| NL | 1033539 | C2 | 9/2008 |
| WO | 2006136662 | A1 | 12/2006 |

OTHER PUBLICATIONS

European Search Report dated Feb. 5, 2010 for Application No. EP 09 25 2652.4-2211.
Patents Act 1977: Search Report under Section 17 (5) ; Application No. GB0821482.7; Mar. 25, 2009.

* cited by examiner

*Primary Examiner* — Daniel Wu
*Assistant Examiner* — Kam Ma
(74) *Attorney, Agent, or Firm* — William R. Walbrun; Boyle Fredrickson, S.C.; John M. Miller

(57) ABSTRACT

According to an aspect of the present invention, there is provided a method and apparatus for controlling access to a restricted area containing machinery. The method comprises receiving from a communications device a location identifier associated with said restricted area and a further identifier, verifying said location identifier and said further identifier, and controlling access to said restricted area based upon said verifying. Controlling access to said restricted area comprises providing a control signal to a controller associated with said restricted area. The controller is arranged to control said machinery in response to said control signal.

18 Claims, 8 Drawing Sheets

ACCESS CONTROL

CROSS-REFERENCE TO RELATED APPLICATIONS

This application claims priority to U.K. patent application number GB0821482.7, filed Nov. 25, 2008, the entire content of which is incorporated herein by reference.

BACKGROUND OF THE INVENTION

The present invention relates to methods and apparatus suitable for use in access control. More particularly, but not exclusively, the invention relates to methods and apparatus for controlling and monitoring entry into secure areas.

Many factories use processes controlled by machines. Many of these processes are fully automated and require only a minimal amount of human interaction, often for the purpose of maintenance. Often a factory has many items of machinery operating in a single area of a factory. Within a single area, each item of machinery may be housed in a respective cell to prevent unauthorised access to particular machinery and to increase safety. If particular machinery in a cell breaks down and requires human interaction, a person is able to attend to that machinery without shutting down other machinery in a factory area which can continue to operate normally within respective other cells.

Access to a cell may be restricted by an access control system such that only those people who may require access are provided with access. A known access control system uses a lock which requires an access code to be provided for entry to a cell. The access control system is arranged such that machinery within the cell is stopped or placed into a safe mode before access to the cell is allowed. When a user enters an access code the access control system does not allow access to the cell until the machinery has been stopped or placed in a safe mode. The person is then able to attend to the machinery safely.

While the known systems described above are advantageous in that they allow access to machinery to be controlled in such a way that access is allowed only when such access can be safely allowed, they are disadvantageous in that users must be provided with relevant codes, and further disadvantageous in that each cell is effectively provided with a standalone access control system over which there is no centralised control and management.

BRIEF DESCRIPTION OF THE INVENTION

According to an aspect of the present invention, there is provided a method and apparatus for controlling access to a restricted area containing machinery. The method comprises receiving from a communications device a location identifier associated with said restricted area and a further identifier, verifying said location identifier and said further identifier and controlling access to said restricted area based upon said verifying. Controlling access to said restricted area comprises providing a control signal to a controller associated with said restricted area. The controller is arranged to control said machinery in response to said control signal.

The invention allows access to be controlled using communications devices and therefore removes the requirement for memorising of codes for access to a particular cell. A record of entries to cells can be maintained centrally from which it is possible to determine why machinery is stopped and who stopped the machinery. Recurrent problems can be recognised and fixed early before significant loss of productivity.

The controller may be arranged to control the industrial machinery in response to the control signal to stop operation of the machinery, or cause operation of the machinery only in a safe mode.

Reference to a "safe mode" is intended to indicate an operating mode of the industrial machinery in which a human operator can safely access the industrial machinery. Thus the particular parameters of a "safe mode" for particular machinery may be determined with reference to that machinery and applicable health and safety guidelines.

Access to the restricted area may be provided through an access point, and the controller may open said access point if but only if the machinery is in a predetermined state. For example the restricted area may be an enclosure (sometimes known as a cell) within which machinery is housed. In such a case the access point may be a door or other barrier in a boundary wall of the enclosure.

Receiving and verifying may be carried out at a server. The server may be associated with a plurality of controllers, each controller being associated with a respective restricted area. For example, the identifiers may be provided using a packet data protocol such as General Packet Radio System (GPRS) over a mobile telephone network such as a Global System for Mobile Communications (GSM) network.

The location identifier and the further identifier may be received over a wireless communications link. The wireless communications link may be provided by a mobile telephone network. The communications device may be a mobile telephone.

The method may further comprise storing access control data in a database, based upon the location identifier and the further identifier.

The method may further comprise providing to the communications device at least one request and receiving from the communications device, in response to the at least one request, at least one response. The at least one response may be verified and controlling access to the restricted area may be further based upon the verifying of the at least one response. The at least one request may request an identification code and/or the at least one request may request information relating to protective equipment. The method may further comprise storing the at least one response in a database.

A method allowing additional checks to be performed when a person enters a restricted area is provided. Such checks may be intended to ensure that all reasonable safety measures are taken.

The further identifier may be an identifier associated with the communications device and the further identifier may be an identifier associated with an operator.

The method may further comprise receiving a request to cause normal operation of the machinery, the request comprising a location identifier and a second further identifier. It may be determined whether the second further identifier and the location identifier satisfy a predetermined criterion and allowing normal operation of the machinery may be allowed based upon the determining. The predetermined criterion may comprise a match between the second further identifier and the further identifier.

A further aspect of the invention provides a system for controlling access to a restricted area. The system comprises a server arranged to receive from a communications device a location identifier associated with said restricted area and a further identifier and to verify said location identifier and said further identifier, and a controller arranged to control access to said restricted area upon receipt of a control signal from said server. Said control signal is sent from said server to said controller based upon said verification. The system may comprise a communications device in communication with said server.

There is also provided a method and apparatus for controlling access to a restricted area. The method comprises reading a location identifier from an electronic identification device using a communications device; and transmitting said read location identifier and a further identifier from said communications device to a server, wherein said server is arranged to verify said location identifier and said further identifier and control access to said restricted area based upon said verifying.

The communications device may be a mobile telephone. The further identifier may be an identifier associated with said communications device The method may further comprise receiving at least one request at said communications device, receiving user input indicating at least one response to said at least one request; and transmitting said at least one response to said server, wherein the server is arranged to control access to said restricted area based upon said verifying of the at least one response.

As another embodiment of the invention, a system for controlling access to a restricted area includes a memory, storing processor readable instructions, and a processor arranged to read and execute the instructions stored in the memory. The processor executes the instructions to receive from a communications device a location identifier associated with said restricted area and a further identifier. The processor further executes to verify the location identifier and the further identifier. The processor executes to control access to the restricted area based upon verifying the identifiers. Controlling access to the restricted area includes providing a control signal to a controller associated with the restricted area. The controller is arranged to control said machinery in response to the control signal. The processor may be associated with either the controller or a server independent of the controller.

It will be appreciated that aspects of the invention can be implemented in any convenient form. For example, the invention may be implemented by appropriate computer programs which may be carried out appropriate carrier media which may be tangible carrier media (e.g. disks) or intangible carrier media (e.g. communications signals). Aspects of the invention may also be implemented using suitable apparatus which may take the form of programmable computers running computer programs arranged to implement the invention.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Various exemplary embodiments of the subject matter disclosed herein are illustrated in the accompanying drawings in which like reference numerals represent like parts throughout, and in which.

Figure 1:
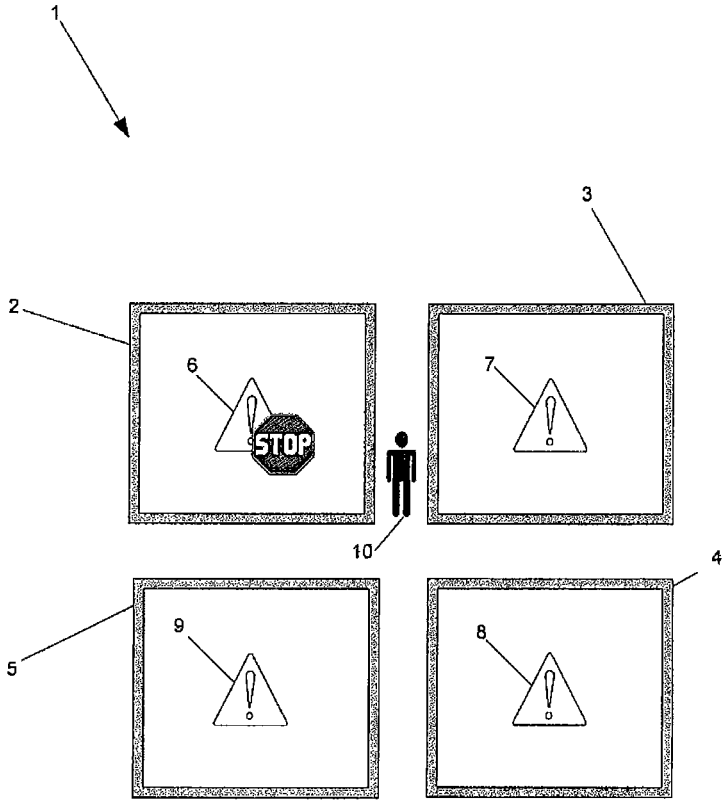
FIG. 1 is a schematic illustration in plan view of a factory area showing four machine cells, one of which has a fault.

In describing the various embodiments of the invention which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION OF THE PREFERRED EMBODIMENTS

Referring to FIG. 1, a portion of a factory floor 1 containing four cells 2, 3, 4, 5, is shown. Each cell 2, 3, 4, 5 contains respective machinery 6, 7, 8, 9. Machinery 6 contained within cell 2 requires attention from an operator 10, such as an engineer, as indicated by "STOP", while machinery 7, 8, 9 in cells 3, 4, 5 continues to function correctly. The machinery 6, 7, 8, 9 is heavy industrial machinery, operation of which can be dangerous. Before a human user can have interaction with any item of machinery 6, 7, 8, 9, that item of machinery must either be stopped or at least placed into an operating mode in which a human user can have safe interaction with the machinery.

Each of the cells 2, 3, 4, 5 is provided with an access control system which is arranged to allow access to a particular cell only when the machinery within that cell is stopped or in a safe operating mode. This is achieved through the use of a controller as described below which only allows a cell door to be opened when a control signal has been provided to machinery within the cell to stop that machinery or place that machinery in a safe operating mode.

Providing each item of machinery 6, 7, 8, 9 with its own cell 2, 3, 4, 5, means that access to a particular item of machinery can be safely provided by affecting only that item of machinery, while other machinery can continue to function as normal, in modes in which human interaction is unsafe. This is because the other machinery is enclosed within separate cells to which access is not currently being allowed. This decreases machine downtime.

Figure 2:
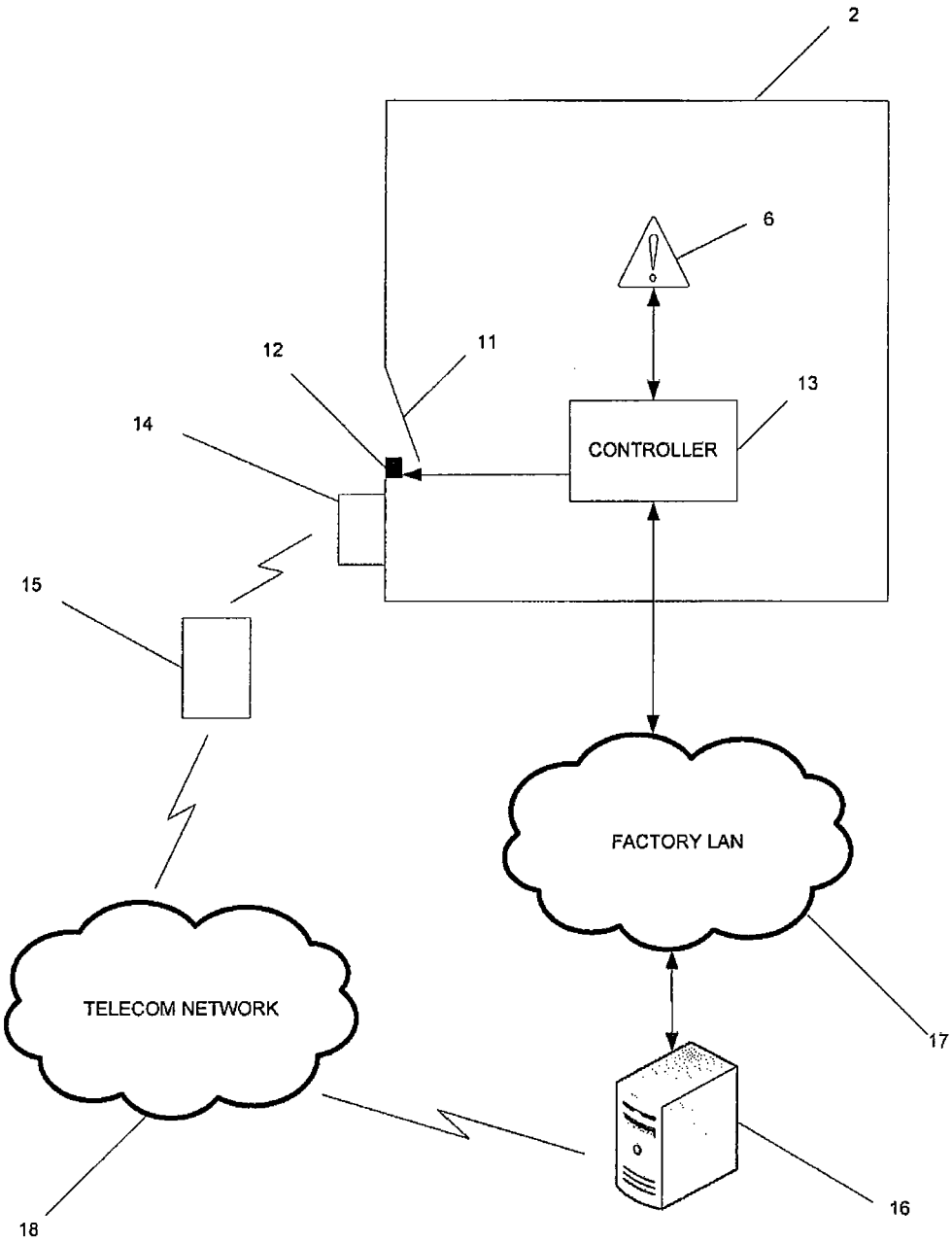
FIG. 2 is a schematic illustration of an access control system according to a first embodiment of the present invention.

Referring now to FIG. 2, a system for controlling access to a cell 2 is shown. Access to the cell 2 is provided through a cell door 11 which is securable in a closed position by a lock 12. The cell 2 contains a controller 13, which controls safe access to the cell 2. The controller 13 may be, for example, an industrial controller and include a processor and memory storing instructions, which may be read and executed by the processor. The controller 13 is connected to the lock 12 to control opening of the cell door 11 and further connected to the machinery 6 to control operation of the machinery 6.

The controller 13 is arranged such that the lock 12 is provided with a signal allowing the door to be opened only when a suitable control signal has been provided to the machinery 6 to place the machinery 6 in a safe mode. The safe mode may prevent operation of the machinery 6 or invoke a limit on operation of the machinery 6 for example by limiting torque, speed or position of the machinery 6. The controller 13 can be implemented in any suitable way, and in some embodiments the controller 13 comprises software components and hardware components.

The cell 2 is further provided with a near field communication (NFC) tag 14. NFC is a short-range high frequency wireless communication technology which enables the exchange of data between devices over about a 10 centimeter (around 4 inch) distance. The technology is an extension of the ISO 14443 proximity-card standard that combines the interface of a smartcard and a reader into a single device. The NFC tag 14 is provided in a suitable location in relation to the cell 2, for example close to the cell door 11.

A communication device 15 containing near field communications technology is shown. Preferably the communication device is a mobile telephone, although other devices such as radio-frequency handsets or simple badge-like devices may be used. NFC enabled mobile telephones are currently available such as the Nokia 6131 NFC, available from Nokia of Helsinki, Finland. Any operator requiring entry to areas of the factory with restricted access is provided with a communications device containing near field communications technology. The operator is further provided with an operator NFC tag which is initially read by the communications device to provide the communications device with an identifier. The identifier read from the the NFC tag can then be used by the communications device as described below.

The communication device 15 is arranged such that when placed in proximity of the NFC tag 14, an identifier associated with the cell 2 is provided from the NFC tag 14 to the communications device 15.

A server 16 is also provided. The server 16 may, for example, include a processor and memory storing instructions, which may be read and executed by the processor. The server 16 is arranged to communicate with the controller 13 through a local area network (LAN) 17 provided within the factory. The server 16 is further arranged to receive and transmit data over a telecommunications network 18. In this way, where the communication device 15 is a mobile telephone or other device with the ability to connect to the telecommunications network 18, data may be transmitted between the communications device 15 and the server 16 over the telecommunications network 18.

The communications device 15 communicates the location identifier obtained from the NFC tag 14, together with the identifier associated with the communications device 15 as read from the operator NFC tag to the server 16 over the telecommunications network 18. The server 16 verifies the permission of a user of the communications device 15 (as determined by the identifier associated with the communications device 15) to enter the cell 2 (based upon the location identifier associated with the NFC tag 14). The server 16 may further send requests for further information to the communications device 15 to further verify entry, as described in further detail below.

The server 16 is arranged to process the location identifier and the identifier associated with the communications device 15 together with responses to any provided requests for further information. If it is determined that received identifiers and the responses satisfy predetermined criteria, the server 16 provides a signal to the controller 13 over the LAN 17. The provided signal is arranged to cause the controller 13 to cause the machinery 6 to operate in a safe mode, and when this has happened, to cause the controller to unlock the cell door 11 by providing a signal to the lock 12.

In the described embodiment signals are provided from the server 16 to the controller 13 over the LAN 17. The LAN 17 can be a wired or wireless network. It will be appreciated that it may not be possible to provide such a LAN, and in such a case it is possible to provide a communications path from the server 16 to the controller 13 in any suitable way, for example using the telecommunications network 18 to which the controller 13 may be connected.

Requests for further information may include verification questions sent to the communications device 15, such as a request that a PIN code is entered. In this way the operator of the communications device 15 can be confirmed as an authorised operator of the communications device 15. Requests for further information may also include health and safety questions such as verification of correct wearing of protective equipment required for safe entry to cell 2. The server 16 is arranged to store responses received to requests for further information, thus providing a record at the server of responses received, for example that the operator has confirmed that all relevant protective equipment is correctly in place.

A further example of a request for further information is a question relating to the reason for requesting entry to the cell. An answer to such a request may take the form of data indicating the nature of a problem with the machinery. By keeping a record of problems associated with particular machinery it is possible to identify recurrent problems that may cause downtime and to resolve such problems through either replacement of affected parts or calling an engineer to further investigate the problem. In this way long term down time of a given device may be prevented.

It will be appreciated that the nature of the requests for further information will be dependent upon the particular environment in which the described system is employed. For example in the nuclear industry a request for further information could be to check if an operator is wearing a radiation protection suit.

The operation of the embodiment of FIG. 2 will now be described in further detail with reference to FIG. 3.

Figure 3:
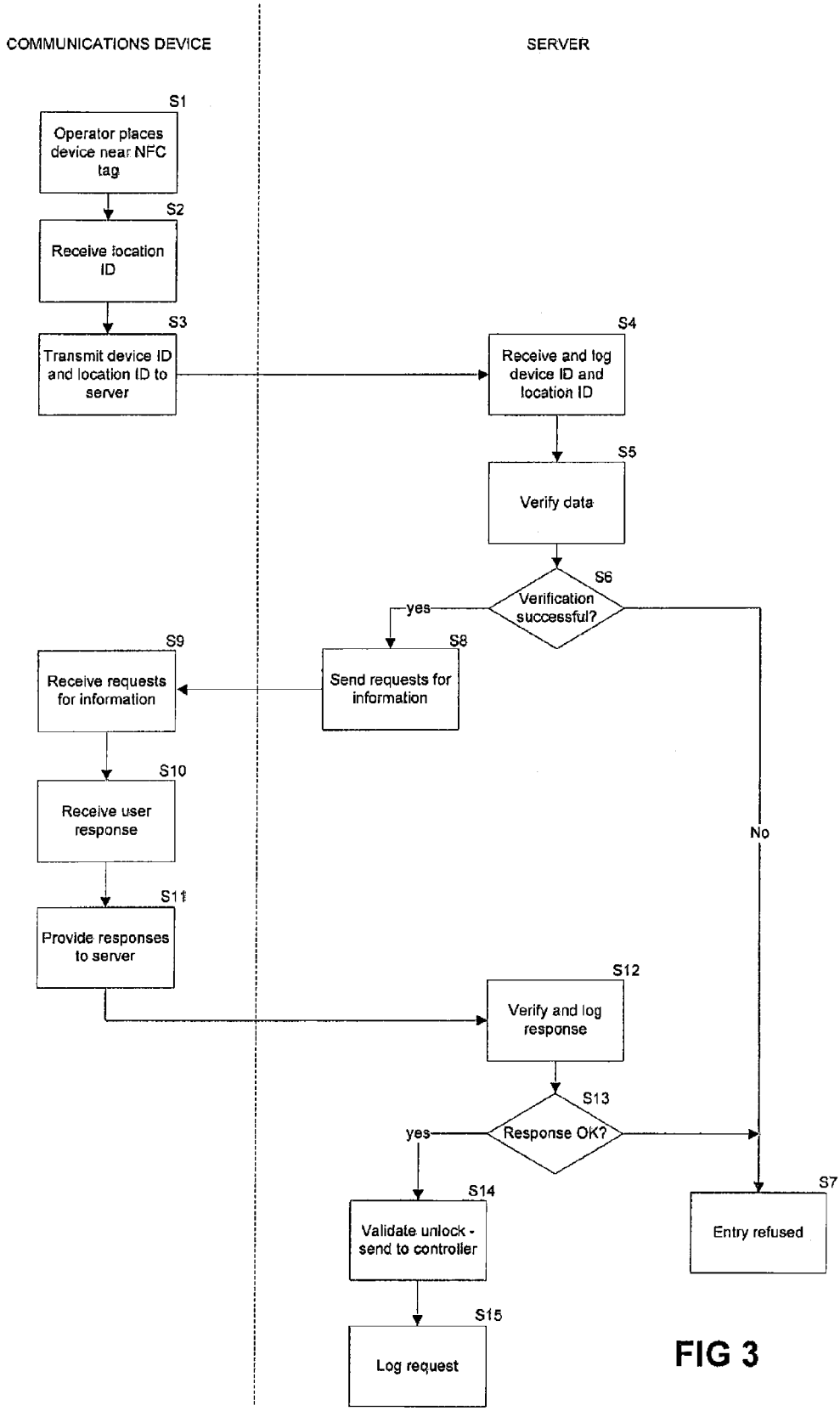
FIG. 3 is a flow chart showing processing carried out to allow access to a cell in the system of FIG. 2.

Referring to FIG. 3, at step S1 an operator places a communications device 15 with near field communications functionality near the NFC tag 14. At step S2 the communications device 15 receives the location identifier from the NFC tag 14 using the NFC protocol, and at step S3 the communications device 15 transmits its device identifier and the location identifier to the server 16. At step S4 the server 16 receives and logs the entry request, including the device identifier of the communications device 15 and the location identifier of the NFC tag 14.

The device identifier can be an identifier which is inherently associated with the communications device 15. For example, where the communications device 15 is a mobile telephone, the device identifier can be an identifier associated with the mobile telephone handset, or with a Subscriber Identity Module (SIM) card inserted into the mobile telephone. For example, the device identifier may be an International Mobile Equipment Identity (IMEI). In alternative embodiments the device identifier may not be inherently associated with the communications device 15, but may instead be based upon an identifier input to the communications device by a user thereof.

At step S5 the server verifies the received data by determining whether stored data indicates that the device identifier should allow access to the cell associated with the location identifier. The verification process may be implemented using a look up table or any other suitable method.

At step S6 if the verification was unsuccessful, processing passes to step S7 where no signal is provided from the server 16 to the controller 13, thereby preventing the cell door 11 being opened. Data indicating that entry is not permitted may be provided to the communications device 15 using the telecommunications network 18.

If it is determined at step S6 verification was successful, processing passes to step S8. At step S8, the server 16 sends a request for information to the communications device 15 over the telecommunications network 18.

Figure 4:
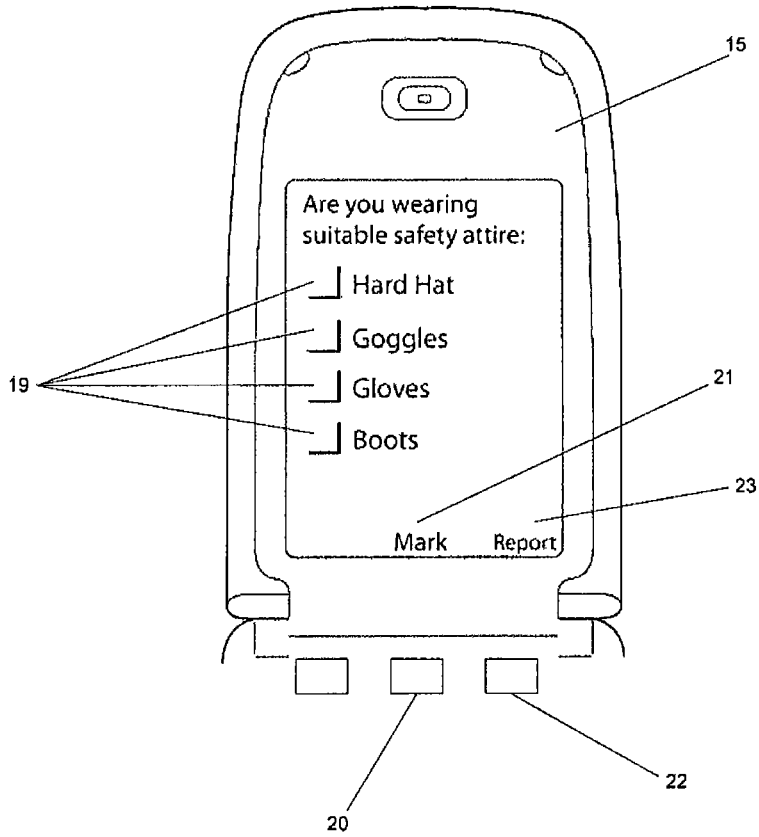
FIG. 4 is a schematic illustration of a communications device display, as used in an embodiment of the invention.

At step S9, the communications device 15 receives the request for information, and data determined by the request for information is displayed to the user on a display screen of the communications device 15 using software provided on the communications device. FIG. 4 shows an example of a request for information as displayed by the communications device 15. It has been described above that request for information can take various forms. In the example of FIG. 4, the request for information relates to protective equipment which an operator is required to wear. The request for information comprises a plurality of items of protective equipment, each of which is displayed together with a respective selection element 19. A user of the communications device can use a cursor key (not shown) to navigate between the selection elements 19. When a particular selection element is highlighted, a key 20 associated with a "Mark" indicator 21 displayed by the communications device can be pressed to cause selection of the currently highlighted selection element. In this way, the user can highlight each selection element 19 in turn, and use the key 20 to mark each item. The operator responds to the requests for information in this way at step S10 of FIG. 3.

When all items are marked, the user may press a key 22 associated with a "Report" indicator 23 to cause data indicating the marked items to be transmitted to the server 16 over the telecommunications network 18 at step S11.

The server 16 receives the responses at step S12. The responses are stored at the server 16 together with data indicating the device identifier and location identifier.

At step S13, the server determines if the responses received at step S12 are valid. In the example of FIG. 4, this verification involves ensuring that the received data indicates that the user has selected each displayed item of protective equipment.

It will be appreciated that in some embodiments steps S8 to S12 may be repeated so as to provide a plurality of requests for information to which responses are received and processed in the manner described above. Additionally, it will be appreciated that some requests for information may not require a particular response. For example a request for information relating to a reason for entering a cell will not have a particular expected response. In such a case the response may not be verified but merely logged by the server 16. Additionally, if it is determined that a response is not as expected, the user may be provided with a further opportunity to provide a response, for example by resending the request for information.

If it is determined at step S13 that a response is not as required (e.g. by comparison with stored data) then processing passes to step S7, and entry to the cell is not permitted. If it is determined at step S13 that a valid response has been received in response to the request for information, then at step S14 the server 16 communicates with the controller 13 to control the machinery 6 to enter a safe mode, and also to allow access to the cell 2 by controlling the lock 12. At step S15 the server logs details of entry to the cell for audit purposes.

Figure 5:
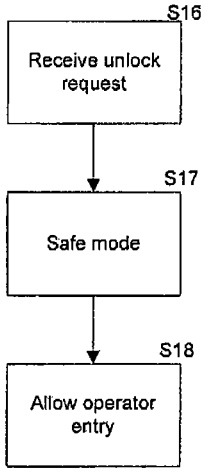
FIG. 5 is a flow chart showing processing carried out at a controller following receipt of an entry request.

FIG. 5 shows processing carried out by the controller 13 in response to receipt of an appropriate signal from the server 16. At step S16, the controller 13 receives a signal from the server 16. At step S17, the controller causes the machinery 6 to enter a safe operating mode. Once the safe mode has provided conditions within the cell 2 that are safe for entry of an operator, at step S18 the cell door 11 is unlocked by providing a signal to the lock 12 to allow safe entry by the operator.

From the preceding description it can be seen that the described method and apparatus for controlling access to a cell ensures that only an authenticated operator can gain access to a cell. An operator requires a communications device provided with a valid device identifier for a particular cell, the cell being identified by the location identifier associated with the NFC tag provided near the cell door. By appropriately configuring the server 16 it is straightforward to initialise and modify operator permissions for an entire area of a factory or even for a number of sites through a remote server. This is achieved by updating data stored by the server 16 indicating device identifiers associated with a particular location identifier so as to indicate which device identifiers can be used to gain access to a cell associated with a particular location identifier.

It is common for employers to provide communications devices such as mobile telephones to employees and these devices are usually kept with the employee at all times. An operator is unlikely to forget or misplace their communications device, meaning that the use of communications devices in the manner described above provides benefits as compared with systems which provide access using, for example, a swipe card. Near field communications technology is currently provided in a number of mobile telephones, meaning that communications devices which are usable in the methods described above are readily obtainable.

The described method and apparatus further allows for checks to be performed such as checking and logging confirmation that an operator is wearing the correct personal protection equipment as described above. In the event of an incident, data logged by the server 16 can be provided during an investigation to show that the operator confirmed they were wearing the correct protective equipment. Each item of protective equipment may be provided with its own NFC tag. An operator may verify correct use of protective equipment by placing the tag of particular protective equipment in proximity of the communications device 15 such that details of the protective equipment (as identified using its NFC tag) are provided to the server 16 over the telecommunications network 18.

Once an operator has entered a cell, it is desirable that it is not possible for the machinery within the cell to operate in a mode other than the safe mode until the operator has left the cell and the cell door 11 has been closed such that it is safe for the machinery to be restarted. The process of restarting a device in a cell after an operator has exited the cell will now be described with reference to FIG. 6.

Figure 6:
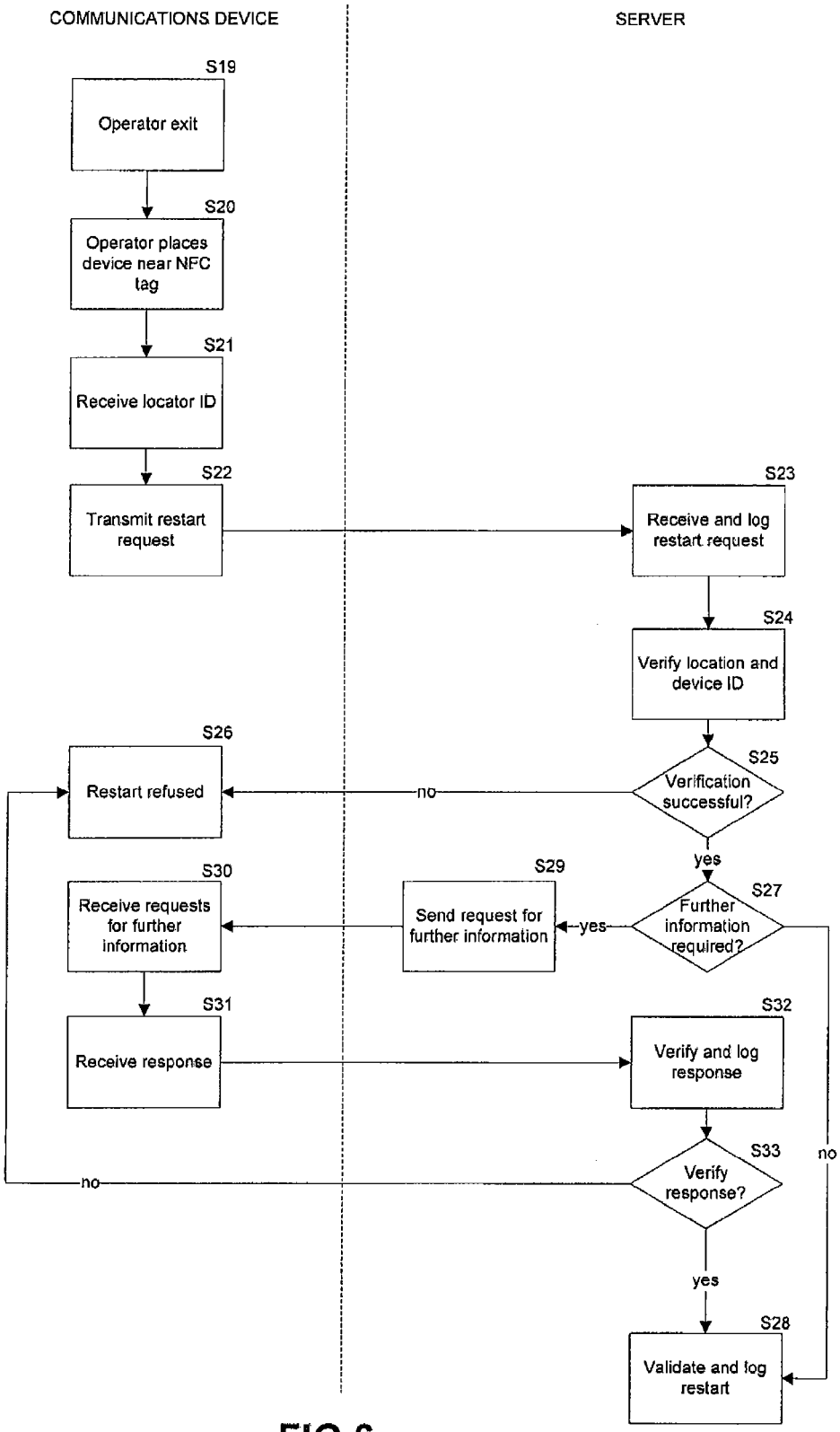
FIG. 6 is a flow chart showing processing carried out to restart stopped machinery.

Referring to FIG. 6, at step S19 an operator exits the cell 2 and closes the cell door 11. At step S20, the operator places the communications device 15 near the NFC tag 14. At step S21, the communications device 15 receives the location identifier associated with the NFC tag 14 from the NFC tag 14. At step S22, the communications device 15 transmits a restart request to the server 16. A restart request includes data indicating the location identifier as received from the NFC tag 14 and the device identifier of the communications device 15.

At step S23, the server 16 receives the restart request and logs the request including the location identifier and device identifier as received from the communications device 15. At step S24, the server verifies the restart request. Verification comprises determining whether the device identifier received corresponds to the device identifier that was received during entry verification.

At step S25, it is determined whether verification was successful. If it is determined at step S25 that verification was unsuccessful, processing passes to step S26 and the machinery 6 is not restarted.

If it is determined at step S25 that verification was successful, processing passes to step S27 where it is determined if requests for information should be sent to the communications device 15. If no requests for information are to be sent, processing passes to step S28 where restart request is logged, and an appropriate signal is provided to the controller 13. The controller 13 on receiving this signal takes action to activate the lock 12 so as to lock the cell door 11, before causing the machinery 6 to resume normal operation.

If it is determined at step S27 that requests for further information are to be sent, then at step S29 the server 16 sends a request for further information to communications device 15. At step S30, the request for further information is received at the communications device 15. A user response to the request for further information is received at step S31. Requests for information provided at step S30 may include requests for confirmation that the cell 2 is clear and that the problem has been resolved. As described previously, a single request for further information may be provided or a series of such requests may be provided with each being sent after a response to a previous request has been verified.

At step S32, the server 16 verifies and logs the responses to the requests for further information and at step S33 it is determined whether the response is acceptable. If it is determined that the response is not acceptable, then processing passes to step S26 where restart of the machine is not allowed. If it is determined that the received response is acceptable, processing passes to step S28 where the restart is logged and an appropriate signal is sent to the controller 12 as described above.

From the preceding description, it can be seen that the described method and apparatus for controlling access to a cell ensures that only an operator who entered the cell can restart machinery within the cell, given the requirement that the device identifier associated with the device used to gain access to the cell matches the device identifier used to restart the machinery. This prevents accidental restart of the machinery whilst an operator is still inside the cell and therefore prevents harm to the operator. Providing requests for information provides an extra level of health and safety assurance as well as providing additional data that can be analysed after the event.

The data that is stored in the process described above with reference to FIGS. 3 and 6 can be analysed to increase factory efficiency and reduce machinery downtime. For example, a record is maintained of exactly who entered a given cell by storing device identifiers. A record may also be kept of how long an operator was in a cell. This data can be used to analyse and audit machine downtime. It may also be used to control personnel entry to allow only those operators who are relatively quick at remedying problems with particular machinery. The methods can also be used to identify personnel who require further training.

Further data regarding problems associated with particular machinery may also be stored using the processes described above to obtain further information, so as to identify why an operator is entering a cell. This data may be used to identify training needs amongst operators for recurrent problems, or to determine if a particular item of machinery is prone to a particular problem. Once such a problem has been identified, steps can be taken to prevent recurrence. For example maintenance experts may be called to examine a recurrent problem, or the data may be used for early identification and diagnosis of a major problem before it occurs.

It will be appreciated that other data items can be stored to provide detailed records of a factory floor operation. The stored data can be analysed to develop best practice methods.

In alternative embodiments it may not be possible or desirable to provide a network connection between the communications device 15 and the server 16. In such embodiments an alternate arrangement of hardware may be provided. Two example arrangements are shown in FIGS. 7 and 8 and discussed below.

Figure 7:
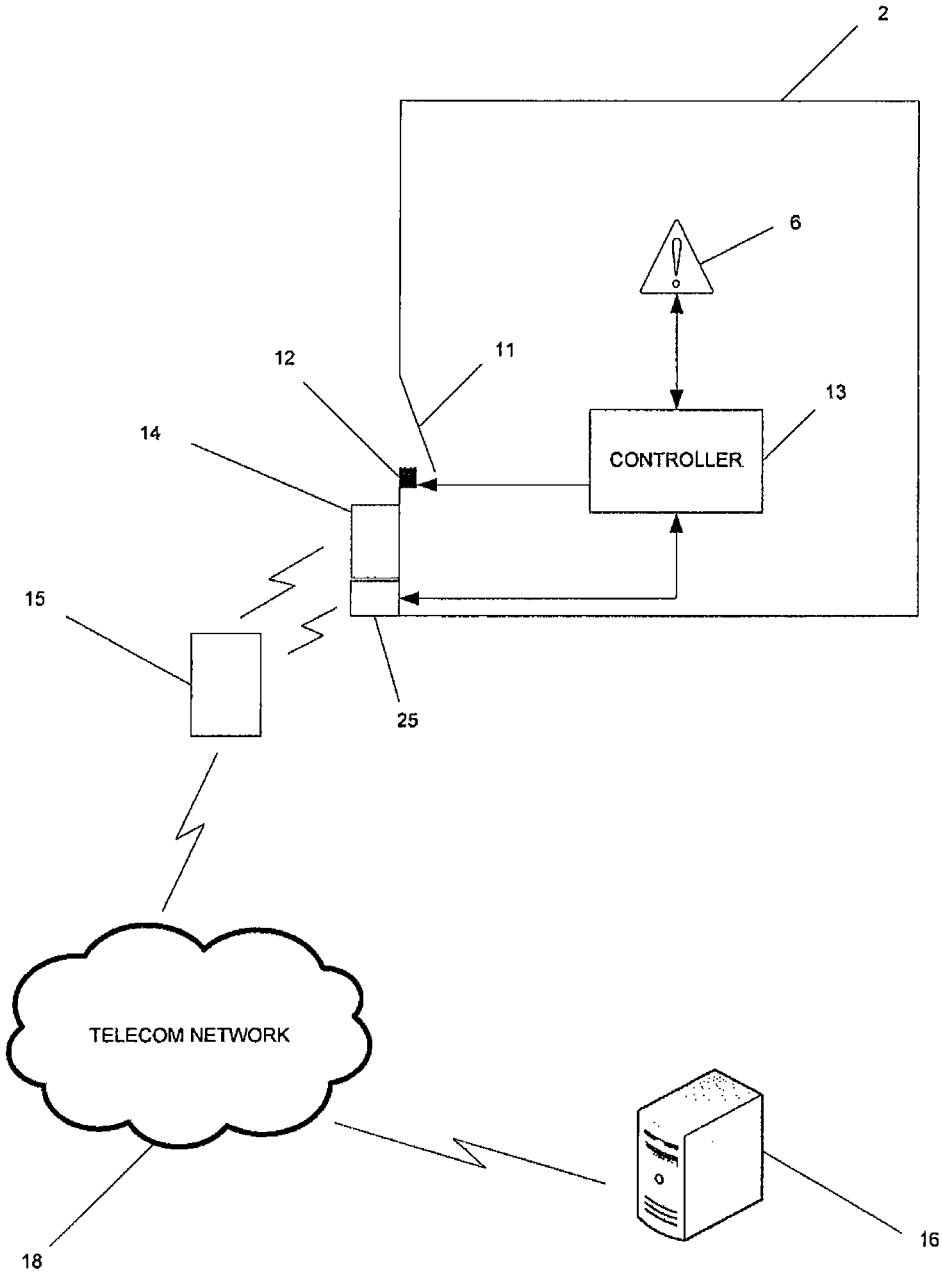
FIG. 7 is a schematic illustration of an access control system according to a second embodiment of the present invention.

Referring now to FIG. 7, an alternative arrangement of hardware to that of FIG. 2 is shown. In the arrangement of FIG. 7, verification of a particular combination of device identifier and location identifier is carried out by a verification module 25. Here, the communications device 15 obtains the location identifier from the NFC tag 14 and provides the location identifier and the device identifier to the verification module 25 using a short range communications protocol. The verification module 25 is arranged to carry out the processing described above, and in particular can provide requests for further information to the communications device 15 and process responses to such requests. The verification module 25 is also arranged to provide signals to the controller 13 in the manner described above so as to cause the machinery 6 to enter a safe mode, and to cause the lock 12 to be deactivated.

It can be seen that the arrangement described with reference to FIG. 7 does not rely on communication over the telecommunications network 18 to allow access to the cell 2. Thus, where access to the telecommunications network is limited, the arrangement of FIG. 7 may be preferred. However, as described above, it is advantageous to store data in a central server for the purposes of various analyses. Thus, in some embodiments, when the communications device 15 is able to access the telecommunications network 18, the communications device 15 is arranged to provide data to the server 16 for storage. Such data may include data indicating a request for entry to various cells.

Figure 8:
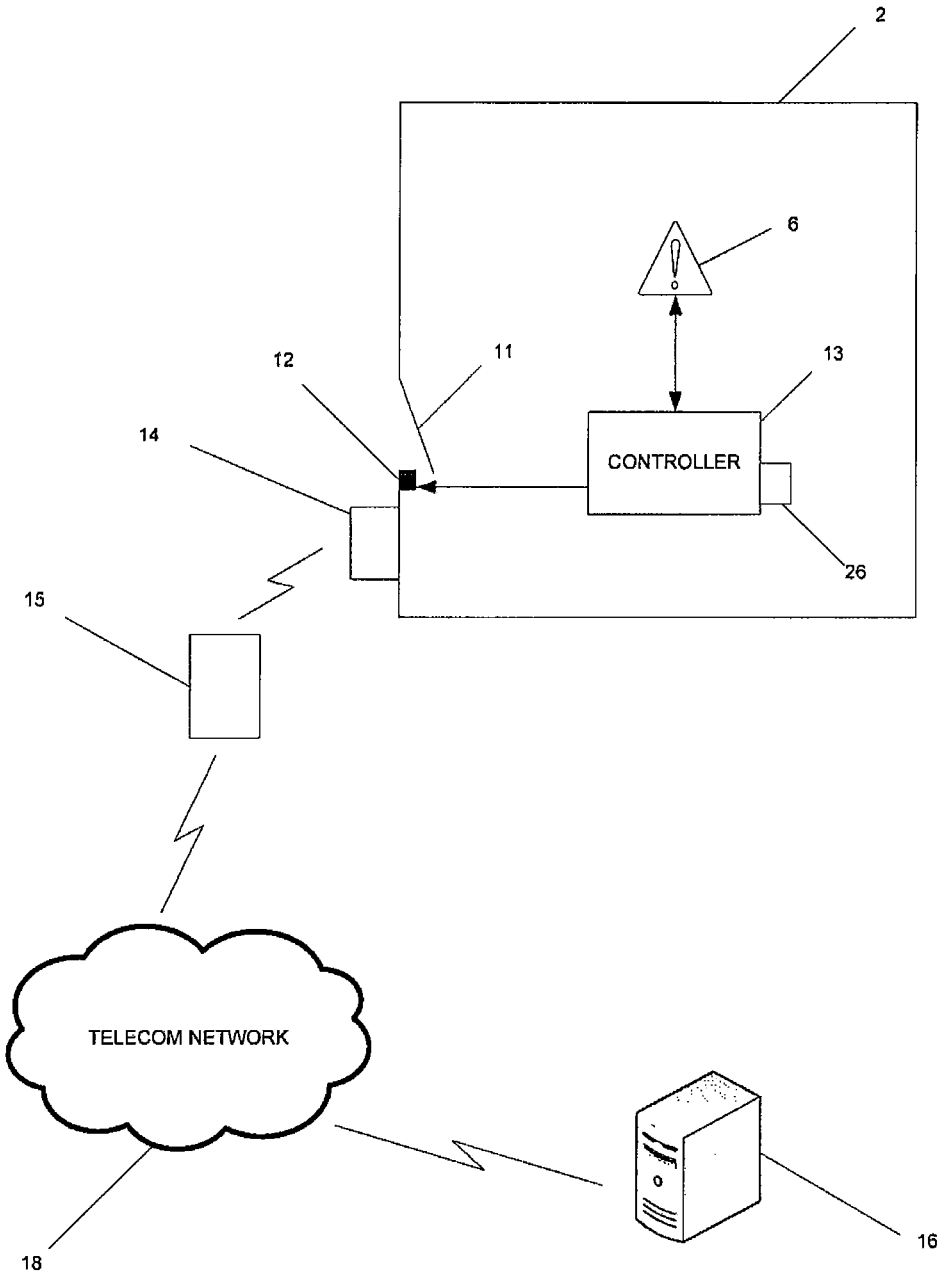
FIG. 8 is a schematic illustration of an access control system according to a third embodiment of the present invention.

Referring now to FIG. 8, a further hardware arrangement is shown. Here, a verification module 26 is associated with the controller 13. The verification module 26 is arranged to provide functionality described above with reference to the verification module 25 of FIG. 7. The verification module 26 may be implemented as part of the controller 13, or as a standalone device which is in communication with the controller 13. Communication between the communications device 15 and the verification module 26 is again provided using a suitable short range communication protocol. It can be seen that the arrangement of FIG. 8 does not require a connection to the server 16 to obtain entry to the cell 2. However data may be still be provided to the server 16 for storage in the manner described above with reference to FIG. 7.

Whilst the embodiments described herein use near field communication, it will be appreciated that any suitable communications path can be used such as RFID. It will further be appreciated that reference to "machinery" in the foregoing description should be construed broadly to cover any moving process to which access is to be controlled.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention

We claim:

1. A method of controlling access to a restricted area containing industrial machinery comprising the steps of:

requesting access to said restricted area, wherein requesting access includes the steps of:

receiving with a mobile communication device a location identifier from a stationary communication device associated with said restricted area;

transmitting a first set of data including the location identifier associated with said restricted area and a further identifier associated with the mobile communication device to a remote processor; and verifying said location identifier and said further identifier at the remote processor;

providing a first control signal to a controller associated with said restricted area from the remote processor based upon said verifying of said location identifier and said further identifier, said controller being arranged to control said industrial machinery to operate in a first mode in response to said first control signal; and restarting said industrial machinery, wherein restarting said industrial machinery includes the steps of:

transmitting a second set of data including the location identifier associated with said restricted area and the further identifier associated with the mobile communication device to the remote processor;

verifying that the further identifier transmitted in the second set of data comprises a match with the further identifier transmitted in the first set of data; and providing a second control signal to the controller associated with said restricted area from the remote processor based upon said verifying of further identifier from the first and second sets of data, said controller being arranged to control said machinery to operate in a second mode in response to said second control signal.

2. The method according to claim 1 wherein said controller is arranged to control said industrial machinery in response to said first control signal to stop operation of said industrial machinery or cause operation of said industrial machinery only in a safe mode.

3. The method according to claim 1 wherein access to said restricted area is provided through an access point, and said controller opens said access point if said industrial machinery is in a predetermined state.

4. The method according to claim 1 wherein said remote processor is a server.

5. The method according to claim 4 wherein said server is associated with a plurality of controllers, each controller being associated with a respective restricted area.

6. The method according to claim 1 wherein said location identifier and said further identifier are transmitted to the remote processor over a wireless communications link.

7. The method according to claim 6, wherein said wireless communications link is provided by a mobile telephone network and said mobile communication device is a mobile telephone.

8. The method according to claim 1 wherein said further identifier is one of an identifier associated with said mobile communication device and an identifier associated with an operator.

9. The method according to claim 1, further comprising:

providing to said mobile communication device at least one request;

receiving from said mobile communication device, in response to said at least one request, at least one response;

verifying said at least one response;

wherein said controlling access to said restricted area is further based upon said verifying of the at least one response.

10. The method according to claim 9 wherein said at least one request requests one of an identification code and information relating to protective equipment.

11. The method according to claim 4, further comprising:

reading said location identifier from an electronic identification device using said mobile communication device, wherein the electronic identification device is the stationary communication device;

transmitting said read location identifier and a further identifier from said mobile communication device to said server, wherein said server is configured to receive and to verify said location identifier and said further identifier and to control access to said restricted area based upon said verifying.

12. The method according to claim 11 wherein said mobile communication device is a mobile telephone.

13. The method according to claim 11 wherein said further identifier is an identifier associated with said mobile communication device.

14. The method according to claim 13, further comprising:

receiving at least one request at said mobile communication device from said server;

receiving user input at said mobile communication device indicating at least one response to said at least one request;

transmitting said at least one response to said server.

15. A system for controlling access to a restricted area comprising:

a memory storing processor readable instructions; and a processor arranged to read and execute instructions stored in said memory;

wherein said processor executes said readable instructions to receive a first set of data from a mobile communication device to request access to said restricted area, the first set of data including a location identifier associated with said restricted area and a further identifier, wherein the location identifier is previously transmitted to the mobile communication device from a stationary communication device associated with said restricted area;

verify said location identifier and said further identifier;

control access to said restricted area based upon said verifying, wherein access to said restricted area is controlled by a first control signal sent to a controller associated with said restricted area, said controller being arranged to control industrial machinery to operate in a first mode in response to said first control signal;

receive a second set of data from the mobile communication device to restart said industrial machinery, the second set of data including the location identifier associated with said restricted area and the further identifier;

verify that the further identifier transmitted in the second set of data comprises a match with the further identifier transmitted in the first set of data; and control access to said restricted area based upon said verifying, wherein access to said restricted area is controlled by a second control signal sent to the controller associated with said restricted area, said controller being arranged to control said industrial machinery to operate in a second mode in response to said second control signal.

16. The system of claim 15 wherein the processor is associated with one of the controller and a server independent of the controller.

17. A system for controlling access to a restricted area comprising:

means for receiving from a mobile communication device a first set of data to request access to said restricted area, the first set of data including a location identifier associated with said restricted area and a further identifier, the location identifier previously transmitted to the mobile communication device from a stationary communication device;

means for verifying said location identifier and said further identifier in the first set of data;

means for controlling access to said restricted area and for operating industrial machinery within said restricted area in a first mode based upon said verifying;

means for receiving from the mobile communication device a second set of data to restart the industrial machinery, the second set of data including the location identifier associated with said restricted area and the further identifier;

means for verifying said further identifier from the first set of data matches said further identifier from the second set of data; and means for controlling access to said restricted area and for operating the industrial machinery within said restricted area in a second mode based upon said verifying that said further identifier from the first set of data matches said further identifier from the second set of data.

18. The system of claim 17 further comprising:

means for reading the location identifier from an electronic identification device with the mobile communication device, wherein the electronic identification device is the stationary communication device; and a server receiving said location identifier and said further identifier from the mobile communication device, wherein said server is arranged to verify said location identifier and said further identifier and control access to said restricted area based upon said verifying.

* * * * *